US009567709B2

(12) United States Patent
Fugitt et al.

(10) Patent No.: US 9,567,709 B2
(45) Date of Patent: Feb. 14, 2017

(54) LOW DENSITY PAPER AND PAPERBOARD WITH TWO-SIDED COATING

(75) Inventors: Gary P. Fugitt, Pittsboro, NC (US); Terrell J. Green, Raleigh, NC (US); Steven G. Bushhouse, Cary, NC (US); Steven Parker, Raleigh, NC (US); Jason R. Hogan, Glen Allen, VA (US); Wei-Hwa Her, Beaumont, TX (US); Scott E. Ginther, Willow Spring, NC (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 13/140,247

(22) PCT Filed: Feb. 5, 2010

(86) PCT No.: PCT/US2010/023290
§ 371 (c)(1),
(2), (4) Date: Jun. 16, 2011

(87) PCT Pub. No.: WO2010/093563
PCT Pub. Date: Aug. 19, 2010

(65) Prior Publication Data

US 2011/0244205 A1 Oct. 6, 2011

Related U.S. Application Data

(60) Provisional application No. 61/151,323, filed on Feb. 10, 2009.

(51) Int. Cl.
*D21H 19/84* (2006.01)
*D21H 19/36* (2006.01)
(Continued)

(52) U.S. Cl.
CPC ..... *D21H 19/84* (2013.01); *D21H 19/20* (2013.01); *D21H 19/36* (2013.01); *D21H 19/54* (2013.01)

(58) Field of Classification Search
USPC ..... 428/219
See application file for complete search history.

(56) References Cited

U.S. PATENT DOCUMENTS 6,582,553 B2 6/2003 Jewell et al.
6,802,938 B2 10/2004 Mohan et al.
(Continued)

FOREIGN PATENT DOCUMENTS

EP 1 052328 A2 11/2000
JP 2009 001953 A 1/2009
(Continued)

OTHER PUBLICATIONS

"Folding Carton Data Sheets" from International Paper Company website at www.ipaper.com/US/EN/Business/CoatedPaperboard/Datasheets.html. Selected data sheets for 14, 20, and 24 pt board. Publication date unknown.

*Primary Examiner* — Tahseen N Khan
(74) *Attorney, Agent, or Firm* — WestRock Intellectual Property Group

(57) ABSTRACT

A paper or paperboard including a cellulose substrate and a coating applied to each side of the paperboard substrate to form a coated structure, the coated structure having a basis weight, a caliper thickness and a Parker Print Surf smoothness, the Parker Print Surf smoothness being at most about 2 microns, the basis weight being less than about Y1 pounds per 3000 ft2, wherein Y1 is a function of the caliper thickness (X) in points and is calculated as follows: Y1=29.15+11.95X−0.07415X2.

20 Claims, 7 Drawing Sheets

Cross-sectional view of one aspect of the disclosed low density paperboard

(51) Int. Cl.

| | |
|---|---|
| ***D21H 19/10*** | (2006.01) |
| ***B32B 29/06*** | (2006.01) |
| *D21H 19/20* | (2006.01) |
| *D21H 19/54* | (2006.01) |

(56) References Cited

U.S. PATENT DOCUMENTS

| | | | | |
|---|---|---|---|---|
| 6,866,906 | B2 | 3/2005 | Williams et al. | |
| 7,208,039 | B2 | 4/2007 | Jones | |
| 7,425,246 | B2 | 9/2008 | Urscheler | |
| 7,504,002 | B2 | 3/2009 | Brelsford et al. | |
| 7,749,583 | B2 | 7/2010 | Fugitt et al. | |
| 2005/0039871 | A1* | 2/2005 | Urscheler | D21H 3/48 162/135 |
| 2007/0044929 | A1* | 3/2007 | Mohan et al. | 162/158 |
| 2007/0169902 | A1 | 7/2007 | Brelsford | |
| 2007/0256805 | A1 | 11/2007 | Reed et al. | |
| 2007/0295466 | A1* | 12/2007 | Fugitt | D21H 19/12 162/115 |
| 2008/0060774 | A1 | 3/2008 | Zuraw et al. | |

FOREIGN PATENT DOCUMENTS

| | | | |
|---|---|---|---|
| JP | 2009 013513 | A | 1/2009 |
| WO | WO 2009/117649 | A1 | 9/2009 |

* cited by examiner

FIGURE 1. Density versus caliper thickness of prior art coated two-side (C2S) paper and paperboard. Substrates created via the disclosed examples are represented by the open circles.

FIGURE 2. Cross-sectional view of one aspect of the disclosed low density paperboard FIGURE 3. Bases weight versus caliper thickness of various exemplary aspects of the disclosed low density C2S paperboard. Disclosed examples are represented by open circles

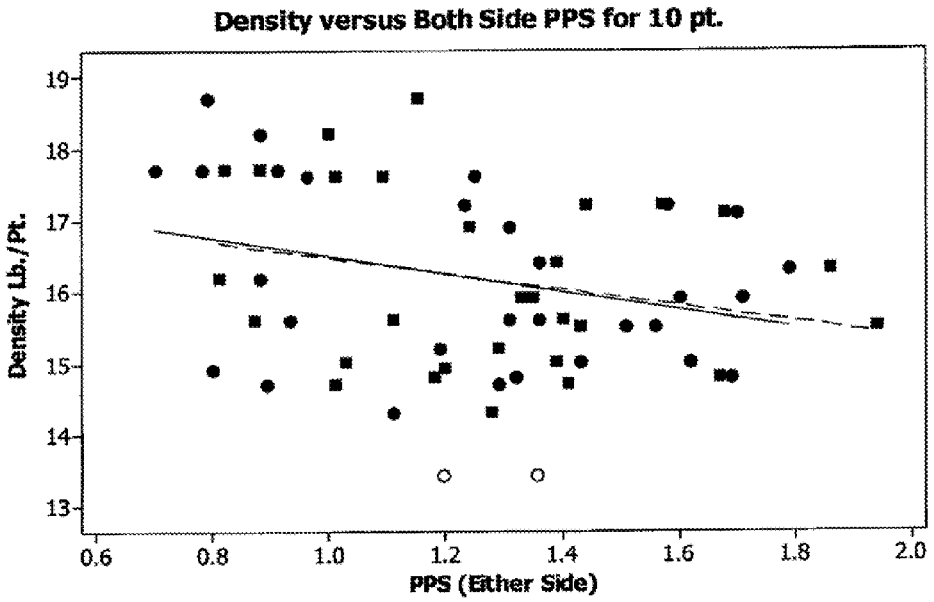
FIGURE 6. Density versus smoothness for 10 point prior art. Open circles indicate our examples.

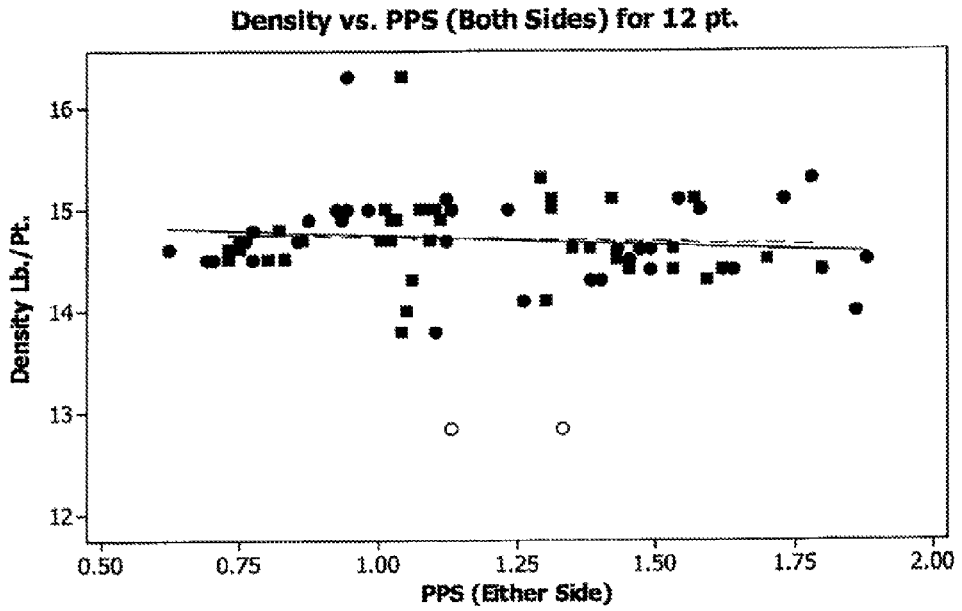
FIGURE 7. Density versus smoothness for 12 point prior art. Open circles indicate our examples.

LOW DENSITY PAPER AND PAPERBOARD WITH TWO-SIDED COATING

PRIORITY

This application claims priority from U.S. Ser. No. 61/151,323 filed on Feb. 10, 2009, the entire contents of which are incorporated herein by reference.

BACKGROUND

The present patent application is directed to low density paper and paperboard and, more particularly, to low density paper and paperboard having a smooth, coated surface on both sides.

Paperboard is commonly used in various packaging applications. For example, high end personal care or commercial printing applications and the like. The paperboard often receives a variety of graphic treatments to enhance its visual impact on the shelf. Likewise, quality papers to be utilized as a medium for printing require smooth coated surfaces, with few imperfections to facilitate the printing of high quality text and graphics.

Conventionally, smoothness is achieved by calendering. Calendering serves to mechanically compress the sheet, providing a surface roughness low enough to produce final coated smoothness acceptable to the industry. However, this compression results in the severe densification of the sheet. Therefore, smooth papers and paperboard are typically more dense (i.e., less bulky) than less smooth paper and paperboard. This effect is magnified when a smooth, coated print surface is required on both sides of the paperboard.

For example, in FIG. 1, the basis weight in pounds per ream (1 ream=3000 $ft^2$) of certain prior art coated two-side (C2S) solid bleached sulfate (SBS) paperboard products and C2S fine paper products is plotted against caliper thickness (1 point=0.001 inch=1 mil), thereby providing a visual representation of prior art paper and paperboard density (i.e., basis weight divided by caliper thickness). As can be seen, for a given caliper, the sheet will have typically been pressed to a given density range in order for the needed surface smoothness to be developed.

Nonetheless, low density is a desirable quality in many paper and paperboard applications. However, preparing a smooth surface using the conventional calendering process requires substantially increasing the density of the fiber substrate.

Accordingly, there is a need for a low density paper and paperboard that provides the desired smoothness on both sides for high quality printing, while reducing raw material cost.

SUMMARY

In one aspect, the disclosed low density paper or paperboard may include a fiber substrate and a coating applied to each side of the fiber substrate to form a coated structure, the coated structure having a Parker Print Surf (PPS 10, soft platen) smoothness on each side of at most about 2 microns, a caliper thickness and a basis weight, the basis weight being less than about $Y_1$, wherein $Y_1$ is a function of the caliper thickness (X) in points and is calculated using Eq. 1 as follows:

$$Y_1=29.15+11.95X-0.07415X^2 \quad \text{(Eq. 1)}$$

In another aspect, the disclosed low density paperboard may include a fiber substrate and a coating applied to each side of the fiber substrate to form a coated structure, the coated structure having a Parker Print Surf smoothness on each side of at most about 2 microns, a caliper thickness and a basis weight, the basis weight being at most about $Y_2$, wherein $Y_2$ is a function of the caliper thickness (X) in points and is calculated using Eq. 2 as follows:

$$Y_2=28.41+11.73X-0.07324X^2 \quad \text{(Eq. 2)}$$

In another aspect, the disclosed low density paperboard may include a fiber substrate and a coating applied to each side of the fiber substrate to form a coated structure, the coated structure having a Parker Print Surf smoothness on each side of at most about 2 microns, a caliper thickness and a basis weight, the basis weight being at most about $Y_3$, wherein $Y_3$ is a function of the caliper thickness (X) in points and is calculated using Eq. 3 as follows:

$$Y_3=27.78+11.51X-0.07207X^2 \quad \text{(Eq. 3)}$$

In another aspect, the disclosed low density paperboard may include a fiber substrate and a coating applied to each side of the fiber substrate to form a coated structure, the coated structure having a Parker Print Surf smoothness on each side of at most about 2 microns, a caliper thickness and a basis weight, the basis weight being at most about $Y_4$, wherein $Y_4$ is a function of the caliper thickness (X) in points and is calculated using Eq. 4 as follows:

$$Y_4=26.89+11.17X-0.07034X^2 \quad \text{(Eq. 4)}$$

In another aspect, the disclosed low density paperboard may include a fiber substrate, a topcoat, and a coating positioned between the fiber substrate and the topcoat, the fiber substrate, the basecoat and the topcoat forming a coated structure, wherein the coated structure has a Parker Print Surf smoothness of at most about 2 microns, a caliper thickness and a basis weight, the basis weight being between about $Y_1$ and about $Y_5$, wherein $Y_1$ and $Y_5$ are functions of the caliper thickness (X) in points and are calculated used Eq. 1 above and Eq. 5 as follows:

$$Y_5=26.15+10.83X-0.06815X^2 \quad \text{(Eq. 5)}$$

Other aspects of the disclosed low density paperboard will become apparent from the following description, the accompanying drawings and the appended claims.

BRIEF DESCRIPTION OF THE DRAWINGS

FIG. 6 is a graphical representation of density versus smoothness (Parker Print Surf) of certain prior art 10 point (caliper) products; and FIG. 7 is a graphical representation of density versus smoothness (Parker Print Surf) values of certain prior art 12 point (caliper) products.

DETAILED DESCRIPTION

Figure 2:
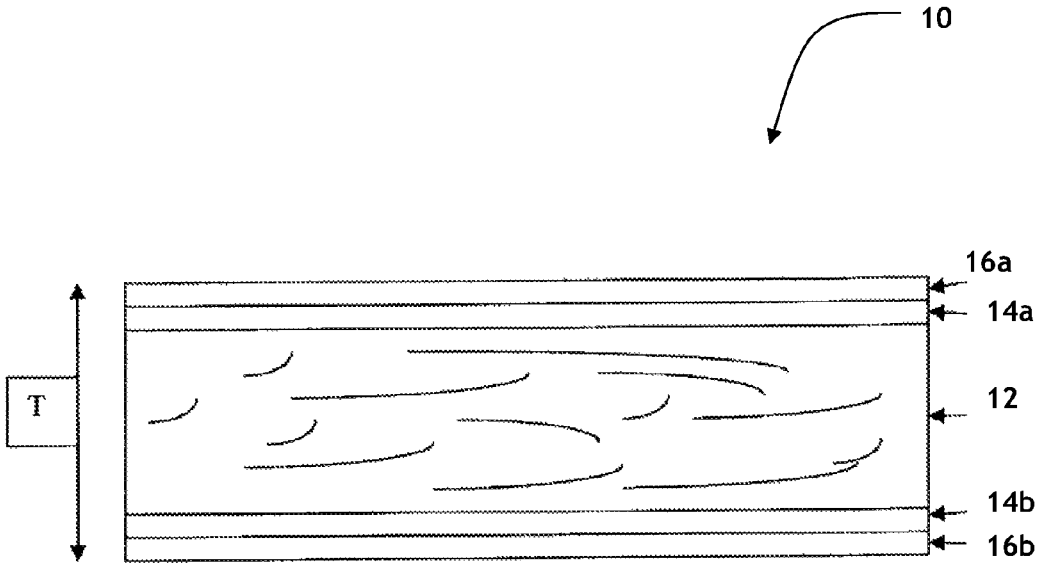
FIG. 2 is a cross-sectional view of one aspect of the disclosed low density paper or paperboard.

Referring to FIG. 2, one aspect of the disclosed low density paperboard, generally designated 10, may include a fiber substrate 12, a basecoat 14*a*, 14*b* and an optional topcoat 16*a*, 16*b*. The coating formulations may differ from side-to-side in formulation as well as in amount applied. Additionally, one side may have only a base coating, while the other side could be both base and top coated. The paperboard 10 may have a caliper thickness T and layers of coating on each side on which graphics may be printed. Additional layers may be used without departing from the scope of the present disclosure.

In one aspect, the fiber substrate 12 may be a paper or paperboard substrate. As used herein, "fiber substrate" broadly refers to any paper or paperboard material that is capable of being coated with a basecoat, and may be a single-ply substrate or a multi-ply substrate. Those skilled in the art will appreciate that the fiber substrate may be bleached or unbleached. Generally, the fiber substrates noted herein have uncoated basis weights of about 65 pounds per 3000 $ft^2$ or more. Examples of appropriate substrates include paper cover stock, linerboard and solid bleached sulfate (SBS). In one particular aspect, the fiber substrate 12 may include a substantially chemically (rather than mechanically) treated fiber, such as an essentially 100 percent chemically treated fiber. Examples of appropriate chemically treated fiber substrates 12 include solid bleached sulfate paperboard or solid unbleached sulfate paperboard.

Additional components, such as binders, fillers, pigments and the like, may be added to the fiber substrate 12 without departing from the scope of the present disclosure. Furthermore, the fiber substrate 12 may be substantially free of plastic pigments or other chemical bulking agents for increasing bulk, such as hollow plastic pigments or expandable microspheres, Still furthermore, the fiber substrate 12 may be substantially free of ground wood particles.

The topcoat 16*a*, 16*b* is an optional layer and may be any appropriate topcoat. For example, the topcoat 16*a*, 16*b* may include calcium carbonate, clay and various other components and may be applied to the basecoat 14*a*, 14*b* as a slurry. Topcoats are well known by those skilled in the art and any conventional or non-conventional topcoat 16*a*, 16*b* may be used without departing from the scope of the present disclosure.

The basecoat 14*a*, 14*b* may be any coating that improves the smoothness of the surface of the paperboard 10 without substantially reducing the caliper thickness T of the paperboard 10, thereby yielding a smooth (e.g., Parker Print Surf smoothness below about 2.0 microns) and low density paper or paperboard. Those skilled in the art will appreciate that the basecoat 14*a*, 14*b* as well as the techniques (discussed below) for applying the basecoat 14*c*, 14*b* to the fiber substrate 12, may be significant factors in maintaining a low density product.

In a first aspect, the basecoat 14*a*, 14*b* may be a carbonate/clay basecoat. The carbonate/clay basecoat may include a ground calcium carbonate component, a platy clay component and various optional components, such as latex binders, thickening agents and the like. The carbonate/clay basecoat may be dispersed in water such that it may be applied to the fiber substrate 12 as a slurry using, for example, a blade coater such that the carbonate/clay basecoat substantially fills the pits and crevices in the fiber substrate 12 without substantially coating the entire surface of the fiber substrate 12.

Specific examples of appropriate carbonate/clay basecoats, as well as techniques for applying such basecoats to a fiber substrate 12, are disclosed in U.S. Ser. No. 12/326,430 filed on Dec. 2, 2008, the entire contents of which are incorporated herein by reference.

Figure 4:
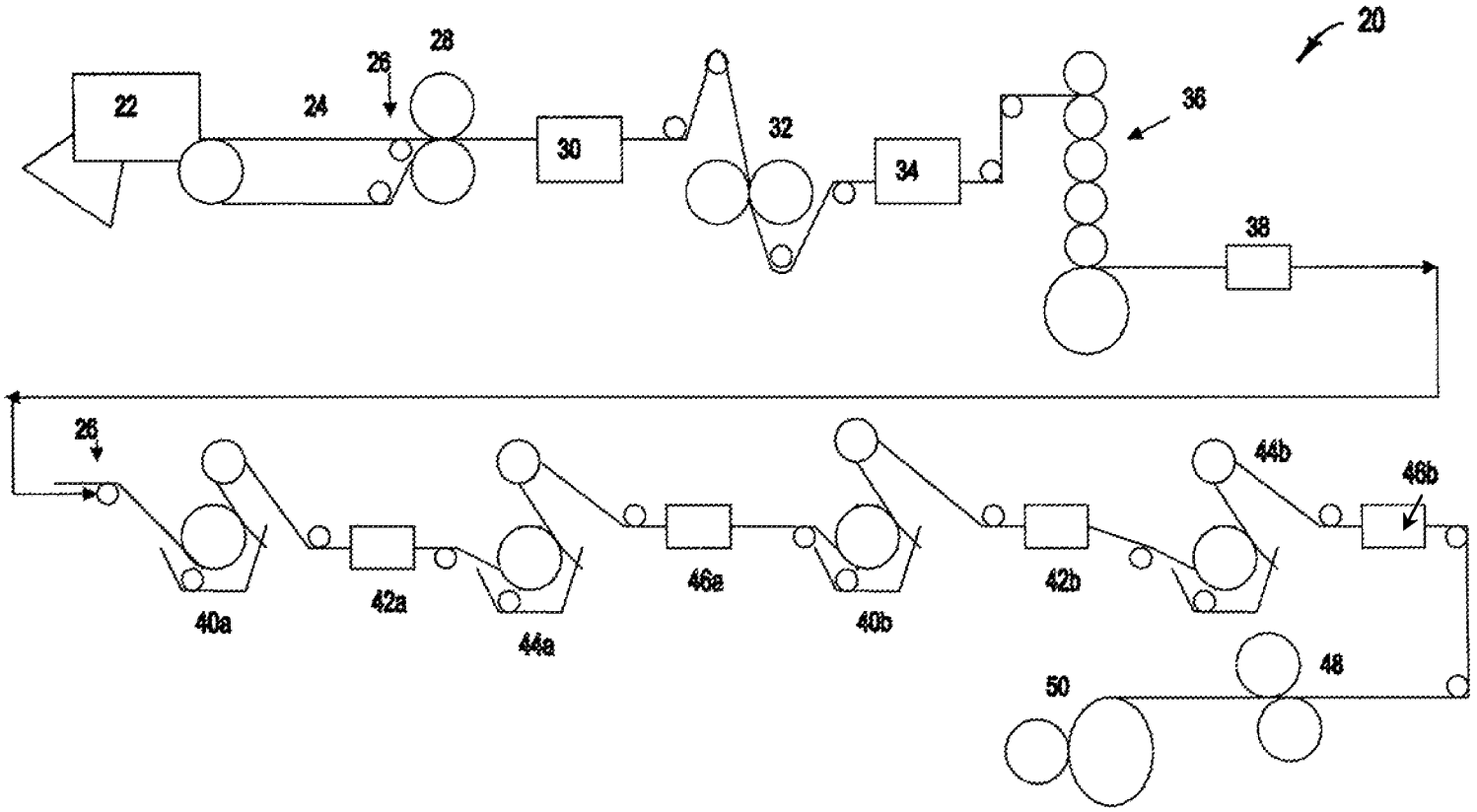
FIG. 4 is a schematic illustration of a first aspect of a process for preparing the disclosed low density paperboard.

Accordingly, in one aspect, a low density paperboard 10 may be prepared by the process 20 illustrated in FIG. 4. The process 20 may begin at the head box 22 which may discharge a fiber slurry onto a Fourdrinier 24 to form a web 26. The web 26 may pass through one or more wet presses 28 and, optionally, through one or more dryers 30. A size press 32 may be used and may slightly reduce the caliper thickness of the web 26 and an optional dryer 34 may additionally dry the web 26. In one aspect, the web 26 may pass through a calender 36 with the nip loads substantially reduced to minimize or avoid reduction in caliper thickness. Preferably, the calender 36 would be run as a dry calender. In another aspect, the calender 36 may be omitted or bypassed. Then, the web 26 may pass through another optional dryer 38 and to the first coater 40*a*. The first coater 40*a* may be a blade coater or the like and may apply the carbonate/clay basecoat 14*a* onto the web 26. An optional dryer 42*a* may dry, at least partially, the carbonate/clay basecoat 14*a* prior to application of the optional topcoat 16*a* at the second coater 44*a*. Optional dryer 46*a* may dry the topcoat 16*a*. Likewise coating will be applied to the opposite side of the sheet by passing through a coater 40*b* which may be a blade coater or the like and may apply a basecoat 14*b* onto the web 26. An optional dryer 42*b* may at least partially dry the basecoat 14*b* prior to application of the optional topcoat 16*b* at coater 44*b*. Another optional dryer 46*b* may finish the drying process before the web 26 proceeds to the optional gloss calender 48 and the web 26 is rolled onto a reel 50.

In a second aspect, the basecoat 14*a*, 14*b* may be a film-forming polymer solution applied to the fiber substrate 12 and then brought into contact with a heated surface in a nip, causing the solution to boil and create voids in the film which remain after the film is dried, resulting in a smooth surface. The film forming polymer may be a starch and the heated surface may be a heated roll.

Specific examples of appropriate film-forming polymers, as well as techniques for applying such polymers to a fiber substrate, are disclosed in PCT/US07/04742 filed on Feb. 22, 2007, the entire contents of which are incorporated herein by reference, in U.S. Ser. No. 60/957,478 filed on Aug. 23, 2007, the entire contents of which are incorporated herein by reference, and in PCT/US07/19917 filed on Sep. 13, 2007, the entire contents of which are incorporated herein by reference.

Figure 5:
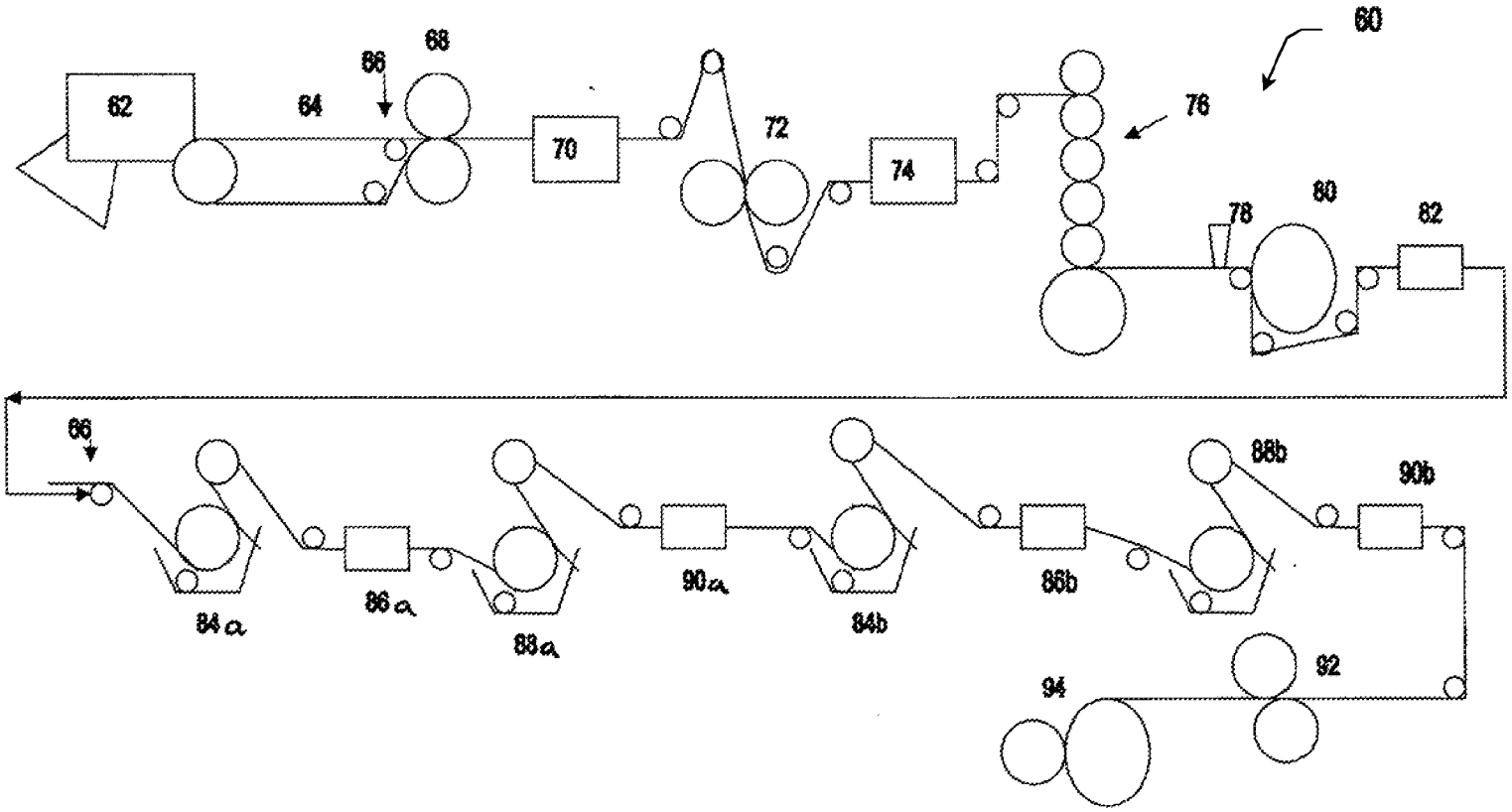
FIG. 5 is a schematic illustration of a second aspect of a process for preparing the disclosed low density paperboard.

Accordingly, in another aspect, a low density paper or paperboard 10 may be prepared by the process 60 illustrated in FIG. 5. The process 60 may begin at the head box 62 which may discharge a fiber slurry onto a Fourdrinier 64 to form a web 66. The web 66 may pass through one or more wet presses 68 and, optionally, through one or more dryers 70. A size press 72 may be used, and may slightly reduce the caliper thickness of the web 66 and an optional dryer 74 may additionally dry the web 66. In one aspect, the web 66 may pass through a calender 76 with the nip loads substantially reduced to minimize or avoid reduction in caliper thickness. If used, the calender 76 may be run as a dry calender. In another aspect, the calender 76 may be omitted or bypassed. Then, the web 66 may pass to an application 78 of the film forming polymer followed by contacting in a nip with a heated roll 80 and a press roll to form a smooth surface with voids in the polymer film. After application and heat/pressure treatment of the film forming polymer, the web 66 may pass through another optional dryer 82 and to the first coater 84*a*. The first coater 84*a* may be a blade coater or the like and may apply a conventional basecoat (e.g., as a second basecoat) onto the starch-coated web 66. An optional dryer 86*a* may dry, at least partially, the basecoat prior to application of an optional topcoat at the second coater 88*a*. Dryer 90*a* may dry the topcoat. The opposite side of the sheet may then be coated via coater 84*b* which may be a blade coater or the like and may apply conventional basecoat onto web 66. An optional dryer 86*b* may at least partially dry the basecoat prior to application of an optional topcoat at the next coater 88*b*. Another optional dryer 90*b* may finish drying before the web 66 proceeds to the optional gloss calender 92 and finished product is rolled onto a reel 94. The gloss calender 92 may be a soft nip calender, a hard nip calender, or may be omitted or bypassed.

At this point, those skilled in the art will appreciate that the basecoats 14*a*, 14*b*, topcoats 16*a*, 16*b* and associated application techniques disclosed above may substantially increase the smoothness of the resulting paper or paperboard 10 without substantially increasing the density of the paper or paperboard 10 (i.e., the caliper thickness of the fiber substrate 12 may be substantially maintained throughout the coating process).

FIGS. 6 and 7 demonstrate the typical trend that as a product becomes more dense it can become smoother. It is obvious from the graphs that the products formed in examples 1 and 2 herein described are significantly different in this regard than other products in the ability to maintain low parker print surf values at new low levels of density.

EXAMPLES

Specific examples of smooth, low density paperboard prepared in accordance with the present disclosure are presented below.

Example 1

A low density uncoated solid bleached sulfate (SBS) board having a basis weight of about 125 lbs/3000 $ft^2$ was prepared using a full-scale production process.

A high-bulk, carbonate/clay basecoat was prepared having the following composition: (1) 50 parts XP 6170 from Imerys Pigments, Inc. (a high aspect ratio clay), (2) 50 parts Hydracarb 60 from Omya, Inc. (a ground calcium carbonate), (3) 18 parts of a latex binder, and (4) a synthetic thickener in a quantity sufficient to raise the viscosity of the blend to 2000 centipoise, at 20 rpm, on a Brookfield viscometer.

A topcoat was prepared having the following composition: 70 parts fine carbonate; 30 parts fine clay; 14 latex binder and minor amounts of coating lubricant, dispersant, synthetic viscosity modifier, defoamer and dye.

The basecoat was applied to the uncoated board using a trailing bent blade applicator. 2-sided coating application was achieved utilizing four coating heads. In this example, the coatings (top and base) on each side of the sheet were identical in composition. The basecoat was applied such that the minimal amount of basecoat needed to fill the voids in the sheet roughness remained on the sheet, while scraping the excess basecoat from the sheet to leave a minimum amount of basecoat above the plane of the fiber surface. The basecoat was applied at a coat weight of about 7 lbs/3000 $ft^2$. The topcoat was applied over the basecoat to further improve the surface smoothness. The topcoat was applied at a coat weight of about 7 lbs/3000 $ft^2$. Coat weights were about the same on each side.

The resulting coated structure had a total basis weight of about 153 lbs/3000 $ft^2$, a caliper of about 0.012 inches (12 points) and a Parker Print Surf (PPS 10S) smoothness of about 1.10 microns on the wire side and 1.30 microns on the felt side.

Example 2

A low density uncoated board having a basis weight of about 110 lb/3000 $ft^2$ was prepared using a pilot production process.

A high-bulk, carbonate/clay basecoat was prepared having the following composition: (1) 50 parts XP 6170 from Imerys Pigments, Inc. (a high aspect ratio clay), (2) 50 parts Hydracarb 60 from Omya, Inc. (a ground calcium carbonate), (3) 18 parts of a latex binder, and (4) a synthetic thickener in a quantity sufficient to raise the viscosity of the blend to 2000 centipoise, at 20 rpm, on a Brookfield viscometer.

A topcoat was prepared having the following composition: 70 parts fine carbonate; 30 parts fine clay; 14 parts latex binder; and minor amounts of coating lubricant, dispersant, synthetic viscosity modifier, defoamer and dye.

The basecoat was applied to the uncoated board using a trailing bent blade applicator. 2-sided coating application was achieved utilizing four coating heads. In this example, the coatings (top and base) on each side of the sheet were identical in composition. The basecoat was applied such that the minimal amount of basecoat needed to fill the voids in the sheet roughness remained on the sheet, while scraping the excess basecoat from the sheet to leave a minimum amount of basecoat above the plane of the fiber surface. The basecoat was applied at a coat weight of about 7 lbs/3000 $ft^2$. The topcoat was applied over the basecoat to further improve the surface smoothness. The topcoat was applied at a coat weight of about 7 lbs/3000 $ft^2$. Coat weights were about the same on each side.

The resulting coated structure had a total basis weight of about 134 lbs/3000 $ft^2$, a caliper of about 0.010 inches (10 points) and a Parker Print Surf (PPS 10S) smoothness of about 1.20 microns on the wire side and 1.30 microns on the felt side.

Figure 1:
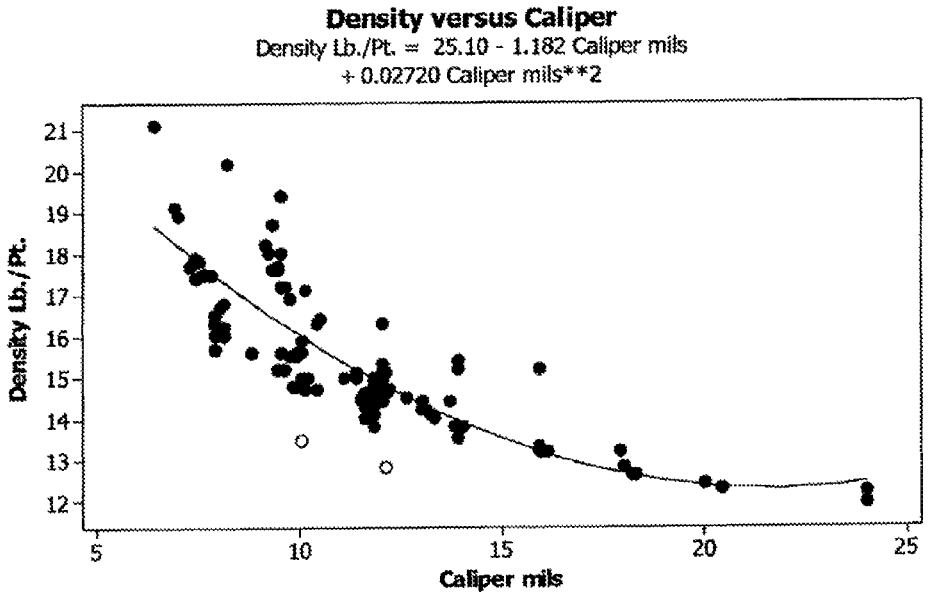
FIG. 1 is a graphical comparison of density versus caliper thickness of certain prior art paper and paperboard materials to paper and paperboard according to the present disclosure.
Figure 3:
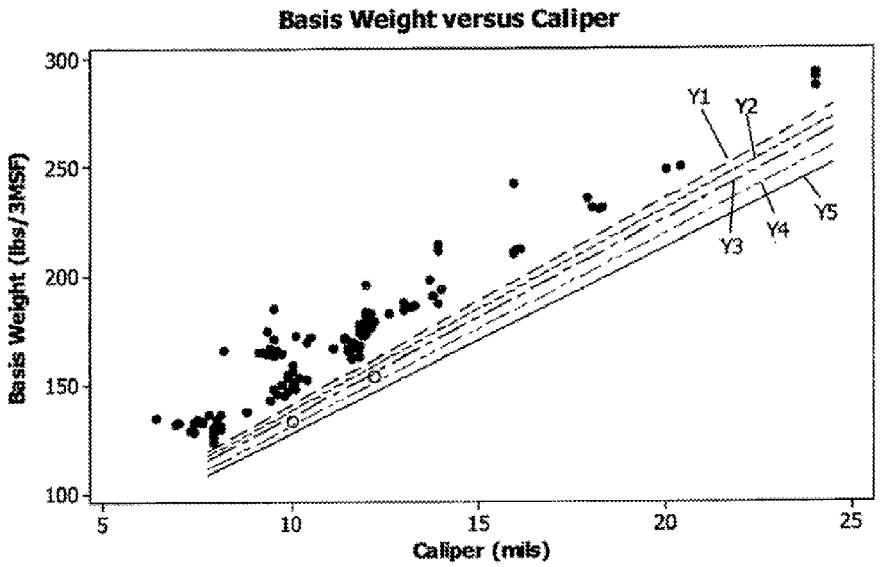
FIG. 3 is a graphical representation of basis weight versus caliper thickness of various exemplary aspects of the disclosed low density paperboard.

The basis weight versus caliper data from Examples 1 and 2 is plotted in FIG. 3, together with basis weight versus caliper data for prior art (FIG. 1). The data points from Examples 1 and 2 fall below curve $Y_1$, which is a plot of Eq. 1, while all of the prior art data is found above curve $Y_1$.

While basis weight data is currently only presented in FIG. 3 for various caliper thickness ranges, those skilled in the art will appreciate that since the disclosed coatings and techniques were capable of achieving surprisingly low densities at about 10 and 12 point calipers, it is to be expected that similar low densities may be achieved at other caliper thicknesses.

Thus, the coated two-sided paperboard of the present disclosure provides desired smoothness (e.g., PPS 10S smoothness below 2 microns, and even below 1.5 microns), while maintaining low density (e.g., basis weight below the disclosed thresholds as a function of caliper thickness). While such paperboard has been desired, it has not yet been achievable in the prior art.

Although various aspects of the disclosed low density paper and paperboard with two-sided coating have been shown and described, modifications may occur to those skilled in the art upon reading the specification. The present patent application includes such modifications and is limited only by the scope of the claims.

What is claimed is:

1. A paperboard comprising:

a solid bleached sulfate (SBS) paperboard substrate having a first side and a second side, wherein said substrate has a basis weight of at least 65 pounds per 3000 ft2, and wherein said substrate is substantially free of chemical bulking agents; and a first coating applied to said first side and a second coating applied to said second side to form a coated structure, said coated structure having a basis weight, a caliper thickness and a Parker Print Surf smoothness, said Parker Print Surf smoothness being at most 2 microns, said basis weight being less than Y1 pounds per 3000 ft2;

wherein the first coating comprises a hyperplaty clay component having an average aspect ratio of at least 40:1;

wherein Y1 is a function of said caliper thickness (X) in points and is calculated as follows:

$$Y1=29.15+11.95X-0.07415X2.$$

2. The paperboard of claim 1 wherein at least one of said first and second coatings includes starch.

3. The paperboard of claim 1 wherein at least one of said first and second coatings includes coarse ground calcium carbonate and high aspect ratio clay.

4. The paperboard of claim 1 wherein said basis weight is less than Y2 pounds per 3000 ft2, wherein Y2 is calculated as follows:

$$Y2=28.41+11.73X-0.07324X2.$$

5. The paperboard of claim 1 wherein said basis weight is less than Y3 pounds per 3000 ft2, wherein Y3 is calculated as follows:

$$Y3=27.78+11.51X-0.07207X2.$$

6. The paperboard of claim 1 wherein said basis weight is less than Y4 pounds per 3000 ft2, wherein Y4 is calculated as follows:

$$Y4=26.89+11.17X-0.07034X2.$$

7. The paperboard of claim 1 wherein said basis weight is at least Y5 pounds per 3000 ft2, wherein Y5 is calculated as follows:

$$Y5=26.15+10.83X-0.06815X2.$$

8. The paperboard of claim 1 wherein said Parker Print Surf smoothness is at most 1.7 microns.

9. The paperboard of claim 1 wherein said Parker Print Surf smoothness is at most 1.5 microns.

10. The paperboard of claim 1 wherein at least one of said first and second coatings includes at least one pigment, and wherein each of said pigments in said coatings is an inorganic pigment.

11. The paperboard of claim 1 wherein said substrate is a single-ply substrate.

12. The paperboard of claim 1 wherein said substrate consists essentially of chemical pulp.

13. The paperboard of claim 1, wherein the first coating comprises a pigment blend including the hyperplaty clay component and a ground calcium carbonate component, wherein at most 60 percent of the ground calcium carbonate component has a particle size smaller than 2 microns.

14. The paperboard of claim 1 wherein said basis weight is at most Y5 pounds per 3000 ft2, wherein Y5 is calculated as follows:

$$Y5=26.15+10.83X-0.06815X2.$$

15. The paperboard of claim 1 wherein at least one of said first and second coatings includes a basecoat and a topcoat, wherein said basecoat is positioned between said topcoat and said substrate.

16. The paperboard of claim 15 wherein at least one of said first and second coatings further includes an intermediate coating layer positioned between said basecoat and said topcoat.

17. A paperboard comprising:

a solid bleached sulfate (SBS) paperboard substrate having a first side and a second side, wherein said substrate has a basis weight of at least 65 pounds per 3000 ft2, and wherein said substrate is substantially free of chemical bulking agents;

a first coating applied to said first side and a second coating applied to said second side to form a coated structure, the first coating and second coating each comprising at least one of an inorganic pigment and starch;

wherein the first coating includes subsurface voids defined by the first coating and having a transverse dimension of at least 6 microns;

wherein said coated structure has a basis weight, a caliper thickness and a Parker Print Surf smoothness, said Parker Print Surf smoothness being at most 2 microns, said basis weight being less than Y1 pounds per 3000 ft2; and wherein Y1 is a function of said caliper thickness (X) in points and is calculated as follows:

$$Y1=29.15+11.95X-0.07415X2.$$

18. The paperboard of claim 17 wherein at least one of said first and second coatings includes coarse ground calcium carbonate and high aspect ratio clay.

19. The paperboard of claim 17, wherein the first coating includes a surface and at least 50% of the first coating surface has subsurface voids defined by the first coating and having a transverse dimension of at least 6 microns.

20. The paperboard of claim 17 wherein said basis weight is at most Y5 pounds per 3000 ft2, wherein Y5 is calculated as follows:

$$Y5=26.15+10.83X-0.06815X2.$$

* * * * *